US012371132B1

(12) United States Patent
Moore

(10) Patent No.: US 12,371,132 B1
(45) Date of Patent: Jul. 29, 2025

(54) TOOL-LESS MATING BULKHEAD CONNECTOR

(71) Applicant: Vatn Systems Inc., Portsmouth, RI (US)

(72) Inventor: Ethaniel Dale Donald Moore, Tiverton, RI (US)

(73) Assignee: Vatn Systems Inc., Portsmouth, RI (US)

( * ) Notice: Subject to any disclaimer, the term of this patent is extended or adjusted under 35 U.S.C. 154(b) by 0 days.

(21) Appl. No.: 18/999,861

(22) Filed: Dec. 23, 2024

(51) Int. Cl.

| | |
|---|---|
| ***B63B 3/08*** | (2006.01) |
| ***B63B 3/13*** | (2006.01) |
| ***B63B 3/56*** | (2006.01) |
| ***B63G 8/00*** | (2006.01) |

(52) U.S. Cl.
CPC ..... *B63B 3/08* (2013.01); *B63B 3/13* (2013.01); *B63B 3/56* (2013.01); *B63G 8/001* (2013.01); *B63G 2008/004* (2013.01)

(58) Field of Classification Search
CPC .... B63B 3/08; B63B 3/13; B63B 3/56; B63G 8/001; B63G 2008/004
See application file for complete search history.

(56) References Cited

U.S. PATENT DOCUMENTS 5,369,565 A * 11/1994 Chen ..... H02J 7/0042 D13/110
9,708,041 B2 * 7/2017 Ohman ..... B63B 34/23
11,352,111 B2 * 6/2022 McNelly ..... B63G 8/001

FOREIGN PATENT DOCUMENTS

CN 2620664 Y * 6/2004 ..... B63B 3/08

OTHER PUBLICATIONS

Teledynemarine.com [online], "Gavia AUV," available on or before Oct. 2, 2023, via Internet Archive: Wayback Machine URL <http://web.archive.org/web/20231002122951/https://www.teledynemarine.com/en-us/products/Pages/gavia-auv.aspx>, retrieved on Jan. 17, 2025, retrieved from URL <https://www.teledynemarine.com/en-us/products/Pages/gavia-auv.aspx>, 12 pages.

* cited by examiner

*Primary Examiner* — Anthony D Wiest
(74) *Attorney, Agent, or Firm* — Fish & Richardson P.C.

(57) ABSTRACT

This disclosure describes systems, and methods for bulkhead connectors, systems, and methods for coupling modules together to form an electrical connection between watertight modules. The bulkhead can include a first face comprising a first guide rail; a second face, parallel to the first face and defining a first slot shaped to receive a second guide rail; a third face, perpendicular to the first face and the second face, the third face defining a first recess configured to receive a first connector plug; and a coupling configured to affix the bulkhead to a hull.

5 Claims, 12 Drawing Sheets

300

TOOL-LESS MATING BULKHEAD CONNECTOR

BACKGROUND

Autonomous underwater vehicles (AUVs) are robotic exploration and utility vehicles that can operate submerged. They can be self-guided, tethered or untethered, and include onboard sensors, power supplies, propulsion systems, and guidance systems. Often AUVs form a hydrodynamic shape such as a cylinder or torpedo shape. Some AUVs can include interchangeable modules, such as a propulsion module, sensor module, battery module, payload module, etc.

SUMMARY

The present disclosure involves bulkhead connectors, systems, and methods for coupling modules together to form an electrical connection between watertight modules. The bulkhead can include a first face comprising a first guide rail; a second face, parallel to the first face and defining a first slot shaped to receive a second guide rail; a third face, perpendicular to the first face and the second face, the third face defining a first recess configured to receive a first connector plug; and a coupling configured to affix the bulkhead to a hull.

Implementations can optionally include one or more of the following features.

In some instances, the bulkhead has a circular profile along a plane parallel to the first face and the second face, and wherein the bulkhead is affixed to an end of a cylindrical portion of the hull.

In some instances, the first guide rail and the first slot are positioned to mate with a second bulkhead comprising the second guide rail, a second slot positioned to receive the first guide rail, and a second recess configured to receive a second connector plug, and wherein when mated, the first recess and the second recess are aligned.

In some instances, the first connector plug when inserted into the first recess and the second connector plug when inserted into the second recess form an electrical connection when the bulkhead is mated with the seconds bulkhead.

In some instances, the bulkhead includes a catch configured to receive a hook of a latch.

In some instances, the bulkhead includes a latch comprising a lever and a hook, wherein the latch is configured to engage the bulkhead with a second bulkhead.

In some instances, the latch is an over-center latch, and wherein the lever comprises a cam surface configured to disengage the second bulkhead when the lever is rotated in a first direction, wherein the lever retracts the hook to engage the second bulkhead when the lever is rotated in a second direction, opposite the first direction.

In some instances, the first slot comprises an opening and an end, wherein a width of the first slot is narrower at the end than at the opening, wherein the first guide rail comprises a base and an end, and wherein a width of the first guide rail is less at the end then at the base.

In some instances, the end of the first slot, and the end of the first guide rail are rounded.

This disclosure describes a system including: a first autonomous underwater vehicle (AUV) module comprising a first hull and a first bulkhead, the first bulkhead comprising: a first face comprising a first guide rail; a second face, parallel to the first face and defining a first slot shaped to receive a second guide rail; a third face, perpendicular to the first face and the second face, the third face defining a first recess configured to receive a first connector plug; the first connector plug positioned in the first recess; a catch, configured to receive a latch; and a first coupling configured to affix the first bulkhead to a first hull; and a second AUV module comprising a second hull and a second bulkhead, the second bulkhead comprising: the second guide rail; a second slot shaped to receive the first guide rail; a second recess configured to receive a second connector plug; the second connector plug positioned in the second recess; a second coupling configured to affix the second bulkhead to a second hull; and the latch comprising a hook and a lever, wherein the hook is configured to engage the catch and mate the first bulkhead and the second bulkhead.

In some instances, the first bulkhead comprises two catches, and wherein the second bulkhead comprises two latches.

In some instances, the two latches each comprise a cam surface configured to disengage the first bulkhead when their respective lever is rotated in a first direction, wherein the lever retracts the respective hook to engage the first bulkhead when the lever is rotated in a second direction, opposite the first direction.

In some instances, when the first bulkhead and the second bulkhead are mated, the first connector plug and the second connector plug form an electrical connection.

In some instances, the first slot comprises an opening and an end, wherein a width of the first slot is narrower at the end than at the opening, wherein the first guide rail comprises a base and an end, and wherein a width of the first guide rail is less at the end then at the base.

In some instances, the end of the first slot, and the end of the first guide rail are rounded.

In some implementations this disclosure describes a method including: lowering a first autonomous underwater vehicle (AUV) module comprising a first bulkhead onto a second AUV module comprising a second bulkhead, wherein the first bulkhead comprises a first slot that receives a second guide rail of the second bulkhead, and wherein the second bulkhead comprises a second slot that receives a first rail of the first bulkhead; engaging at least one hook of a latch of the second bulkhead with at least one catch of the first bulkhead; and rotating at least one lever of the latch of the second bulkhead into an engaged position to couple the first bulkhead with the second bulkhead.

In some instances, when the first bulkhead and the second bulkhead are coupled, a first connector plug and a second connector plug form an electrical connection.

In some instances, the first bulkhead is coupled to a first hull of the first AUV module to form a pressure tight first AUV module, and wherein the second bulkhead is coupled to a second hull of the first AUV module to form a pressure tight second AUV module.

In some instances, the method includes: submerging the coupled first AUV module and second AUV module in a liquid.

In some instances, the method includes decoupling the first AUV module and the second AUV module by rotating the at least one lever of the latch into a disengaged position; removing the hook from the catch; and lifting the first AUV module off the second AUV module.

The details of these and other aspects and embodiments of the present disclosure are set forth in the accompanying drawings and the description below. Other features, objects, and advantages of the disclosure will be apparent from the description, drawings, and claims.

DESCRIPTION OF DRAWINGS

Some example embodiments of the present disclosure are illustrated by way of example and not limitation in the figures of the accompanying drawings.

DETAILED DESCRIPTION

This disclosure describes bulkhead connectors, systems, and methods for coupling modules together to form an electrical connection between watertight modules. Modular autonomous underwater vehicles (AUVs) enable flexibility and adaptability in varying environments. Modules can include, for example, a propulsion module, payload module, battery modules, sensor module, guidance module, or others. For example, a modular AUV may include a propulsion module at the rear, a payloads module in the center, and a guidance, sensors and communications module at the front. In an example mission where a longer range is required, a battery module can be installed between the propulsion and the payload module, thereby extending the AUV's range and enabling the longer-range mission. This is advantageous in that different modules can be developed and deployed individually, without needing to replace or re-develop the entire AUV. While the disclosed bulkhead connector is discussed in the context of an AUV, other contexts are possible. For example, this bulkhead connector is applicable for aerospace, aviation, marine, utility, and other applications.

In some implementations, the disclosed bulkhead connector enables rapid reconfiguration and enhances the flexibility of an AUV's watertight connection. This is enabled by a bulkhead connector that can allow modules to be coupled and uncoupled rapidly, and without the need for specialized tools and equipment. The disclosed connector provides a watertight seal between AUV modules, while enabling electrical communication between modules.

Some implementations of the disclosed bulkhead connector are advantageous in that they do not require the use of tool and enables precise alignment and connection tolerance. For example, such bulkhead connectors can be configured to be self-indexing, therefore not requiring precise alignment to connect. In some implementations, the connector is also resistant to interference from debris or corrosion which may occur in a marine environment. For example, using dovetailed guides and slots that have an increasingly tightening tolerance during coupling allows for self-indexing while ensuring proper alignment of relatively sensitive pin connectors. This additionally reduces the force required to decouple the connector, as after it is unseated, there is less contact between guides and slots. Further, a majority of the contract surface area of the connector can be exposed for easy cleaning, lubrication, and maintenance, to avoid buildup of debris or other material that may interfere with a tight connection.

Figure 1:
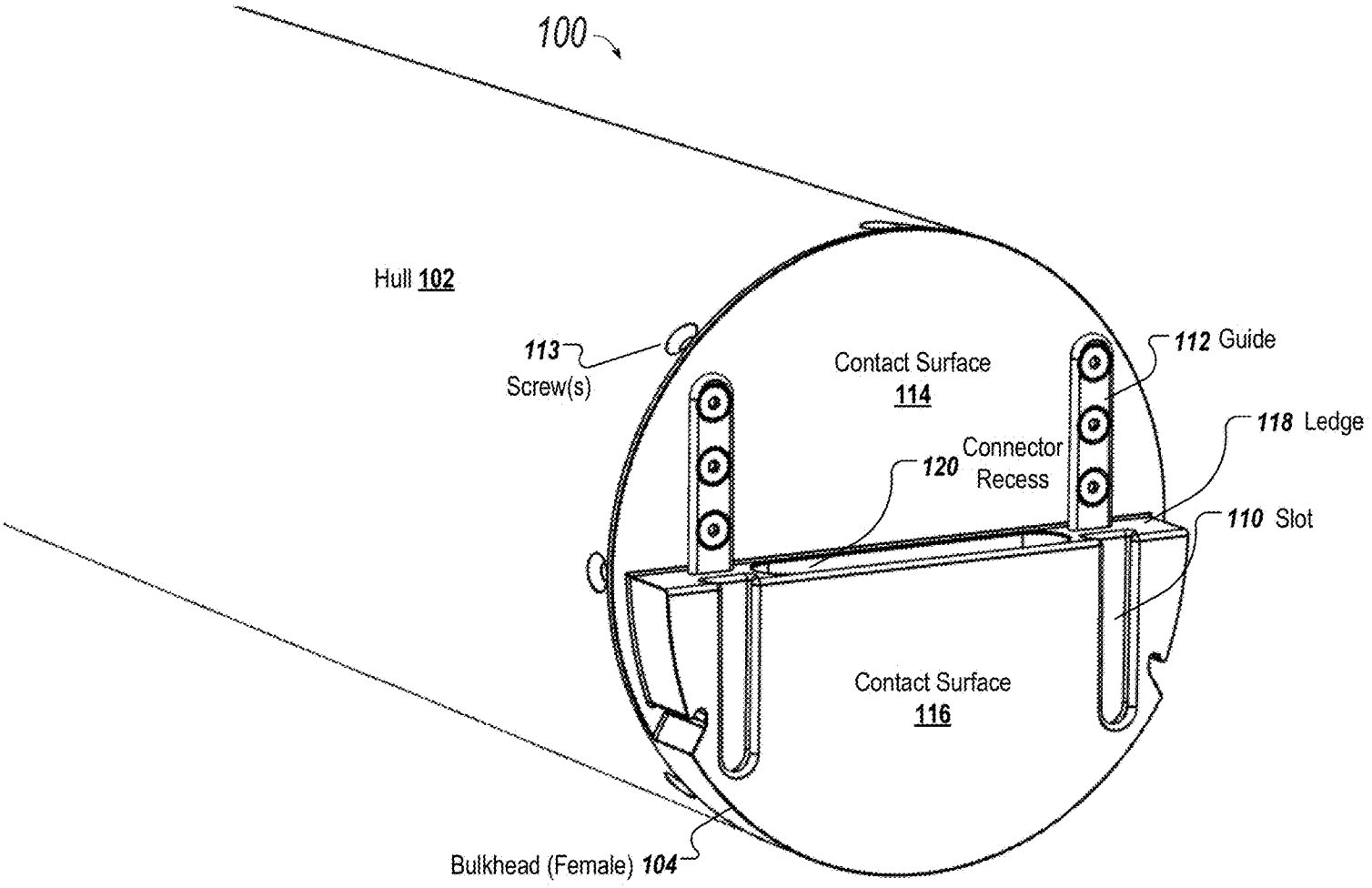
FIG. 1 illustrates a perspective view of an AUV module with a bulkhead connector attached.

FIG. 1 illustrates a perspective view of an AUV module 100 with a bulkhead connector attached. The AUV module 100 can be a cylinder and can house electrical components or other components for the AUV. The illustrated AUV module 100 includes a hull 102, connected to a bulkhead 104. The bulkhead 104 can include seals such as O-rings or gland packing and be configured to fit within the hull 102. As illustrated, several screws 113 are embedded around the hull 102 into the bulkhead 104. While illustrated as a cylinder, hull 102 can be any suitable shape, including having an ovoid, elliptical, square or beveled square, or other cross sections. In these implementations, the bulkhead 104 can be shaped to fit within hull 102 with a recessed portion (209 in FIG. 2A below) and, in some instance, form a seal. In some instances, such as in flooded AUV modules, the bulkhead 104 does not include seals, and some leakage past the bulkhead 104 into the hull 102 is permitted.

The bulkhead 104 includes two contact surface 114 and 116, which will rub against the contact surface on an adjacent bulkhead when the AUV module 100 is coupled to another module. By keeping contact surfaces 114, 116, and ledge 118 exposed and generally flat, they become easy to clean, lubricate, and/or polish, which can ensure they are easily mated or unmated even in a marine (e.g., saltwater) or industrial environment. A pair of guides 112 are mounted to contact surface 114, and slots 110 are recessed into contact surface 116. In some implementations, more than two, or fewer than two guides and slots are possible. For example, three, four, or one slot and guide is possible. In the illustrated implementation, the guide 112 and slot 110 are aligned, such that an identical guide and slot on a connecting bulkhead will fit. In some implementations, the guide 112 is not aligned with slot 110, and each bulkhead is configured to specifically mate to a separate, different type of bulkhead.

A connector recess 120 is on a ledge 118 between contact surface 116 and contact surface 114. This connector recess 120 can house a connector plug and seals for enabling an electrical connection between bulkheads. The connector plug is described in more detail below with respect to FIGS. 4 and 5.

As depicted in FIG. 1, the AUV module 100 is illustrated upside down to reveal the connector recess 120. As shown below, the AUV module 100 can be rotated 180 degrees to be lowered onto an adjacent module when connected. By connecting the modules in a vertical configuration, gravity can assist in providing initial forces needed to seat the bulkhead connectors together, with final force provided by latches is discussed in more detail below.

Figure 2A:
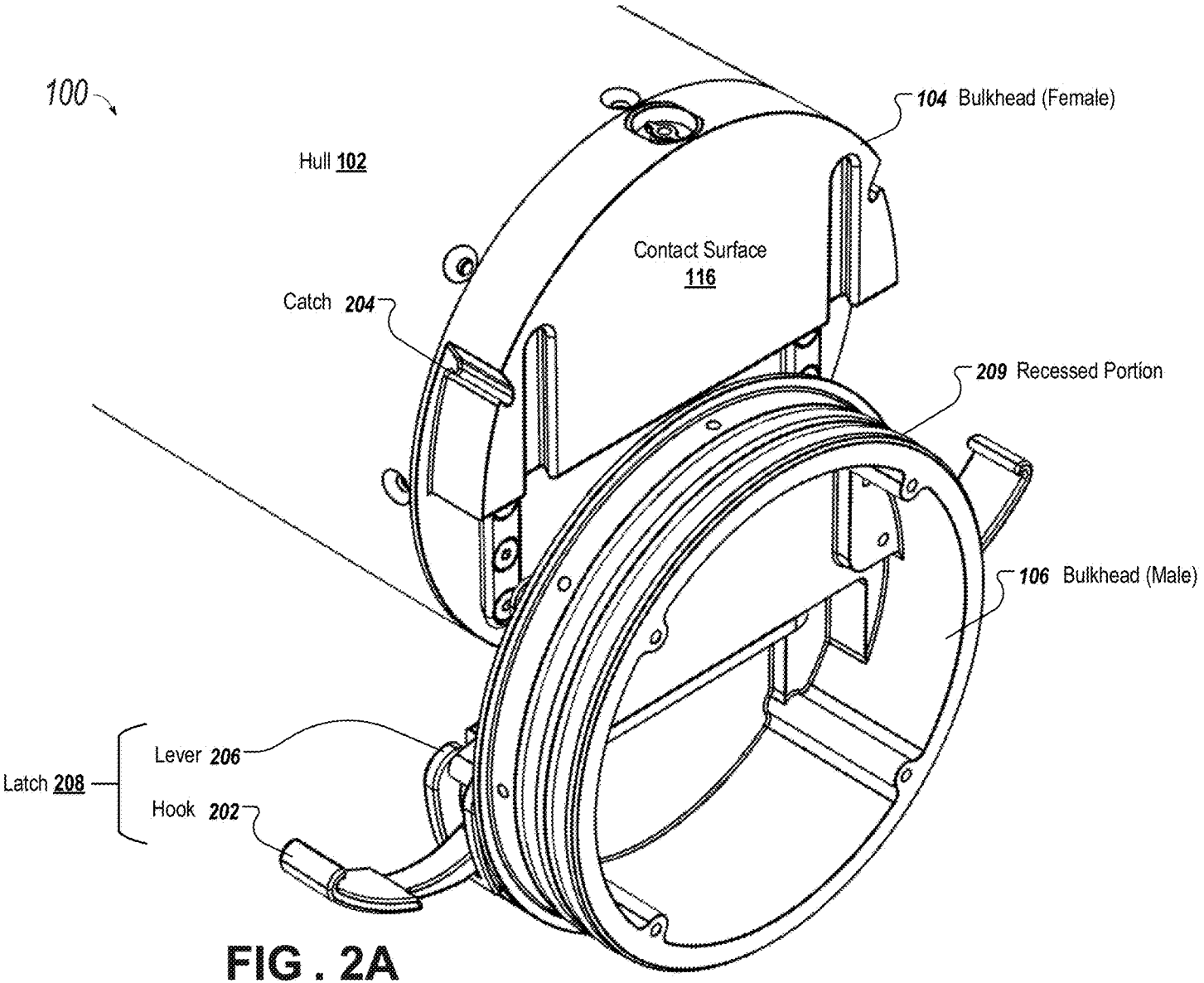
FIG. 2A illustrates a perspective view of an AUV module with a bulkhead connector attached and an unmated bulkhead connector positioned to be coupled.

FIG. 2A illustrates a perspective view of an AUV module with a bulkhead connector 104 attached and an unmated bulkhead connector 106 positioned to be coupled. The AUV module 100 can be lowered onto the male bulkhead connector 106, and the female bulkhead connector's 104 slots and guides will index onto those of the male bulkhead connector 106.

In the illustrated example, the female bulkhead connector 104 and the male bulkhead connector 106 are very similar. Each includes identical slots and guides such that they fit together when the female bulkhead 104 is lowered onto the male bulkhead 106. The female bulkhead 104 includes a pair of catches 204, onto which the male bulkhead 106 can latch. The male bulkhead 106 includes a pair of latches 208, which each have a lever 206 and a hook 202. In some implementations the catches 204 are shaped such that when unlatching the latch 208, a sloped surface within the catch 204 forces the hook 202 away from the bulkhead 104. This can minimize the risk of inadvertent re-hooking or relatching during decoupling operations. In order to unlatch, a user simply lifts up on the lever 206, raising the hook 202, which will press against the upper surface of the catch 204 and fall to the side. Both the male bulkhead 106 and the female bulkhead 104 can include a recessed portion 209 that allow them to fit within, and be affixed to hulls (e.g., hull 102).

Figure 2B:
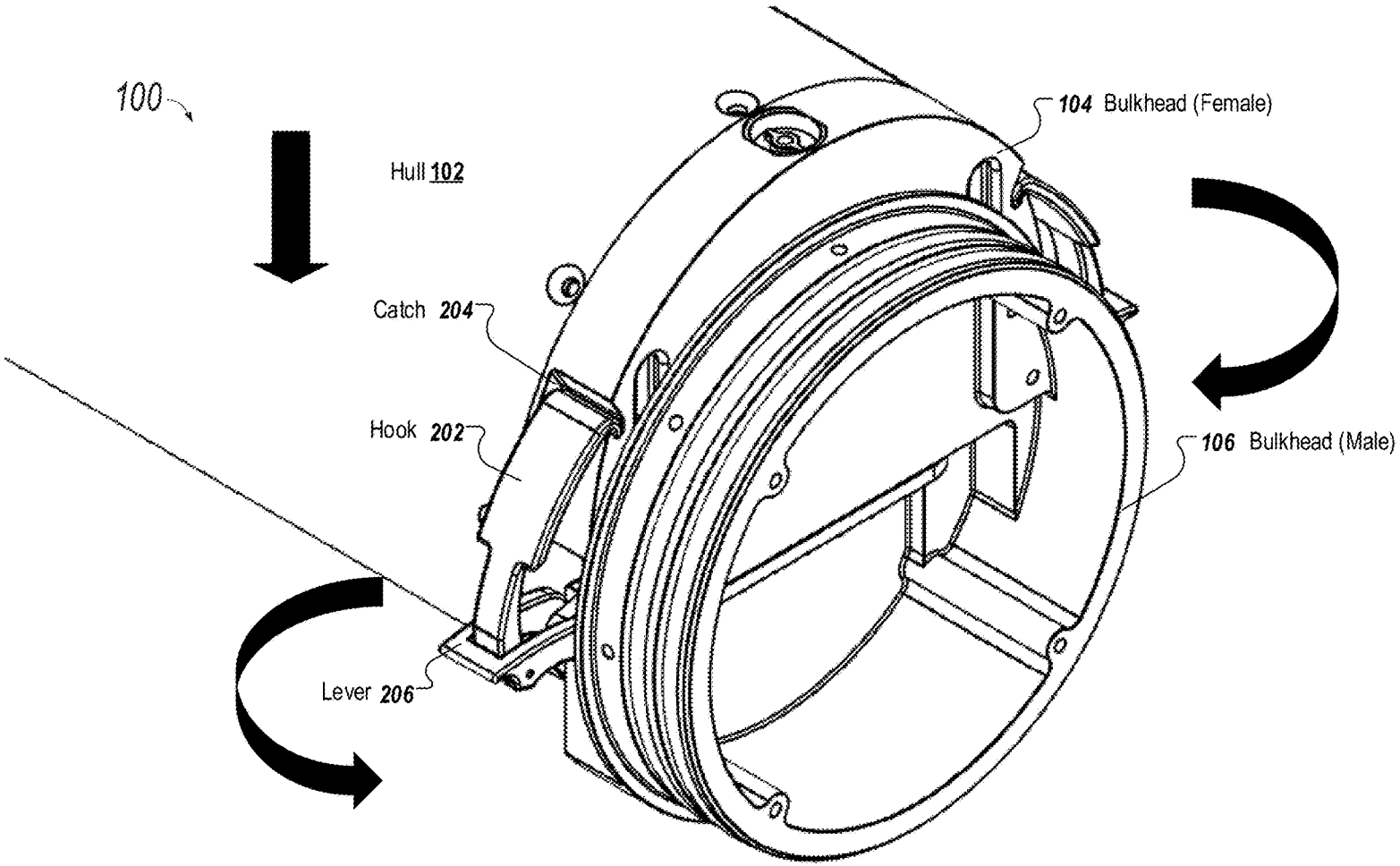
FIG. 2B illustrates a perspective view of an AUV module with a bulkhead connector attached and partially mated with another bulkhead connector.
Figure 2C:
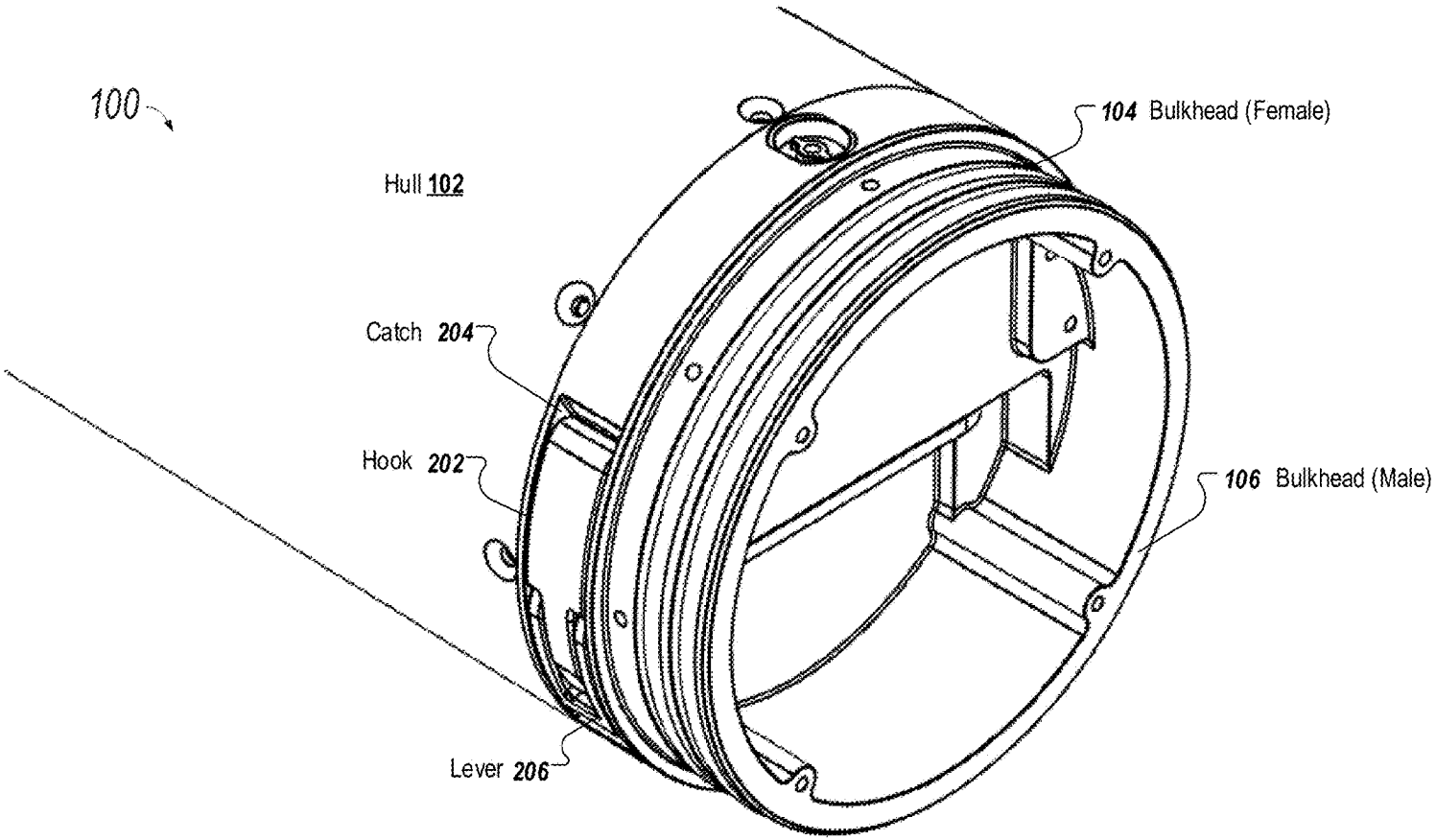
FIG. 2C illustrates a perspective view of an AUV module with a bulkhead connector attached and mated with another bulkhead connector.

FIG. 2B illustrates a perspective view of an AUV module 100 with a bulkhead connector attached and partially mated with another bulkhead connector. As the AUV module 100 including the female bulkhead 104 is lowered onto the male bulkhead 106, the hooks 202 can be placed in their respective catches 204. Levers 206 can then be pressed down, either by hand or using a tool, to cinch down the AUV module 100 and fully engage the female bulkhead 104 to the male bulkhead as shown below in FIG. 2C.

Figure 3:
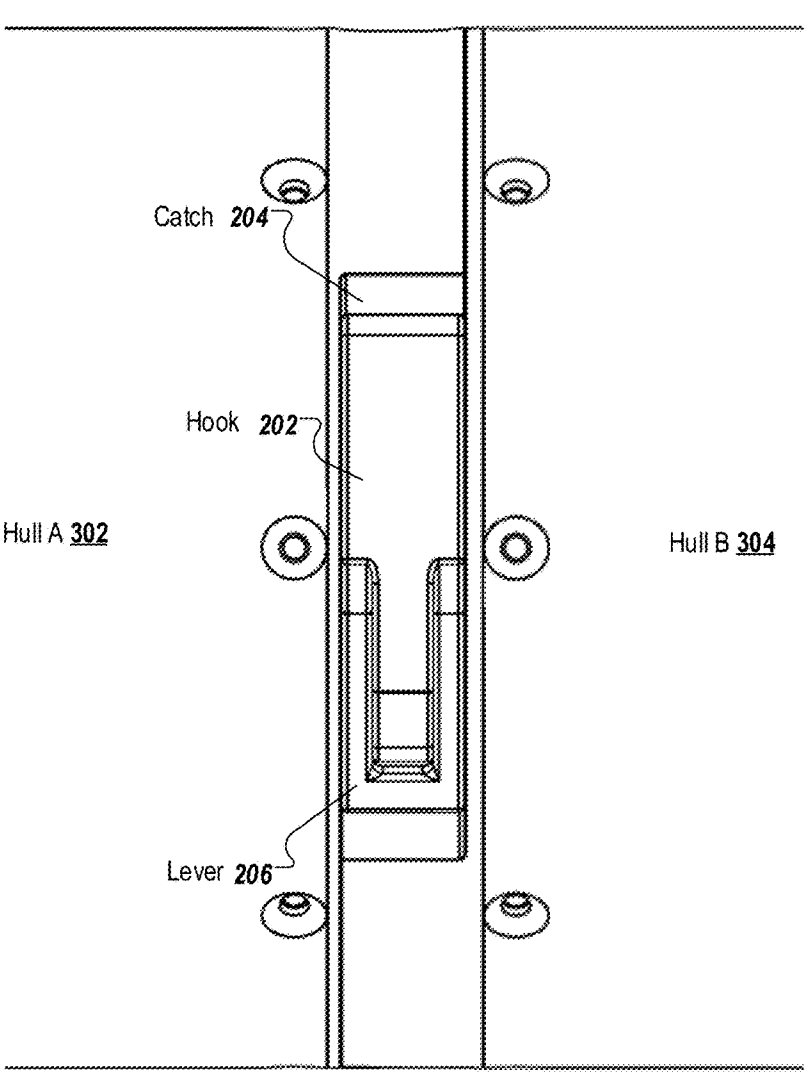
FIG. 3 is a side view of a pair of mated AUV modules.

FIG. 3 is a side view of a pair of mated AUV modules. As shown, hull A 302 and hull B 304 are mechanically connected. Axial and transverse loads between the two hulls are transferred through the contact surfaces and the ledge of the respective bulkheads, preventing forces from being transferred through the electrical connectors within. As shown in FIG. 3, the bulkhead connectors form an electrical and mechanical connection between the AUV modules without protruding outside the footprint of the modules themselves, and therefore do not significantly contribute to drag as the AUV moves through the liquid. It should be noted that, while the mated AUV modules are shown with their respective bulkheads perpendicular or near perpendicular to the outer face of their respective hulls, other angles and implementations are possible. For example, each bulkhead could seal within its respective hull with a slope, where one hull is lowered onto the other hull at an angle instead of directly vertically.

Figure 4A:
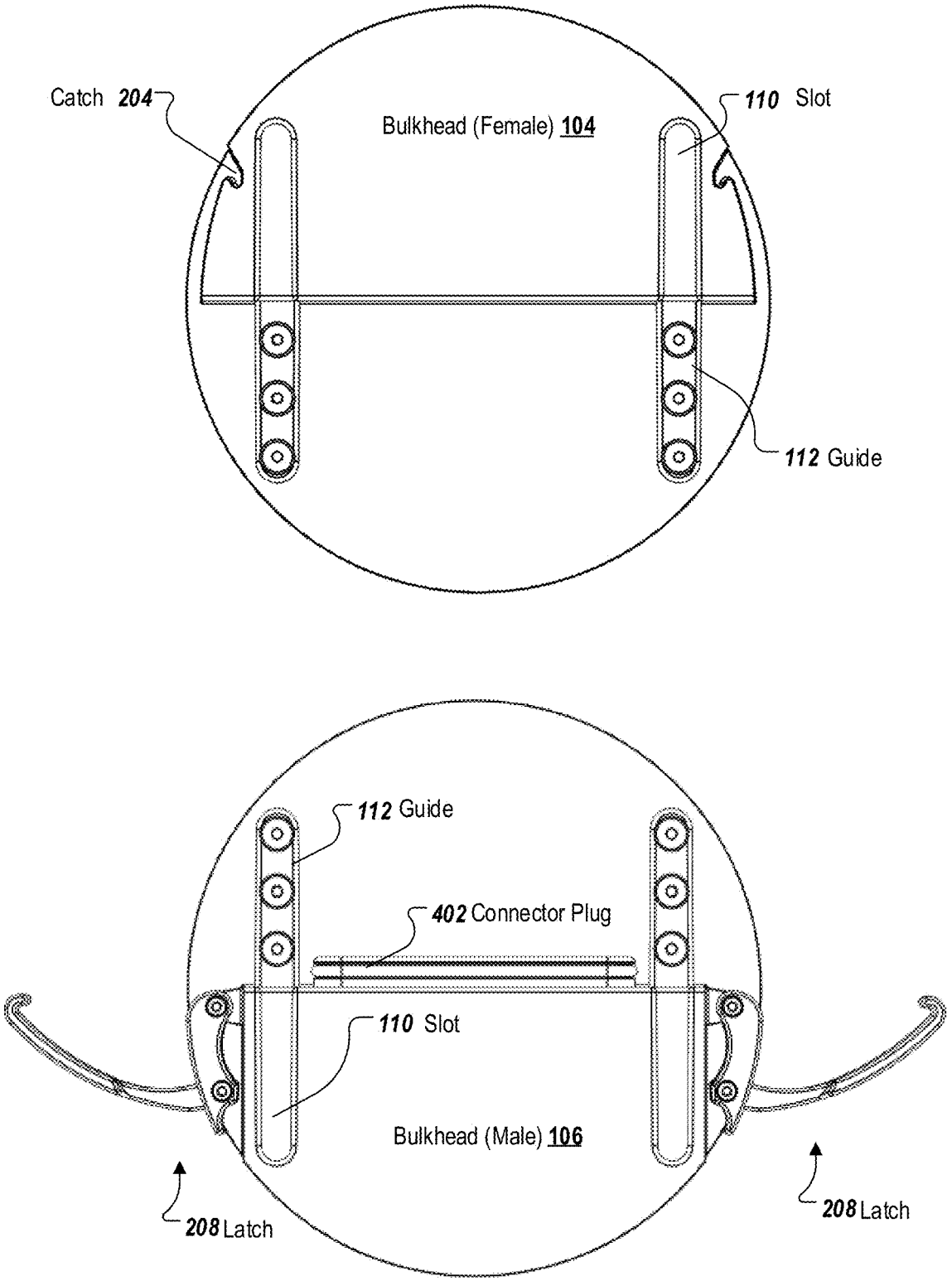
FIG. 4A illustrates a front view of a female bulkhead connector and a male bulkhead connector.

FIG. 4A illustrates a front view of a female bulkhead connector 104 and a male bulkhead connector 106. The female bulkhead connector 104 includes catches 204, and the connection plug recess (illustrated in FIG. 1) is deeper than the male bulkhead 106. The male bulkhead 106 includes latches 208 and has a shallower connection plug recess. As shown in FIG. 4A, connector plug 402, when fully seated in the male bulkhead 106, protrudes above the ledge. While bulkheads 104 and 106 are described as "male" and "female" in this specification, they are generally structurally similar, with minor differences such as recess depth and latch configuration. The term "male" and "female" are used for clarity and to distinguish between these variations, but do not necessarily require any particular structural differences (e.g., insertion of one bulkhead or component of one bulkhead into another). Further, the terms "male" and "female" are independent regarding whether a bulkhead includes latches or catches. In some implementations, each bulkhead contains both a latch and a catch, as described below with respect to FIG. 9.

Figure 4B:
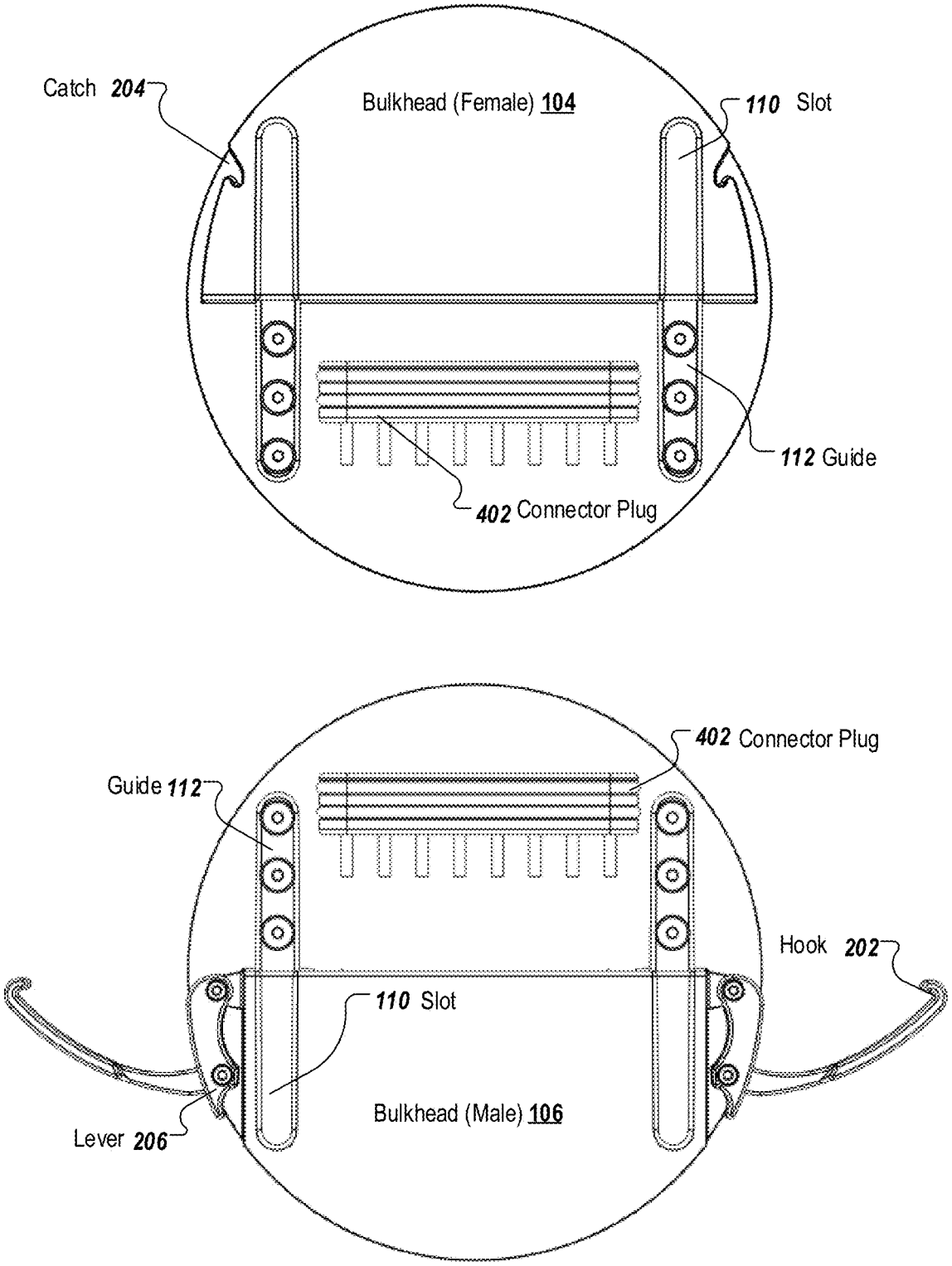
FIG. 4B illustrates a front view of a female bulkhead connector and a male bulkhead connector with connection plugs extracted.

FIG. 4B illustrates a front view of a female bulkhead connector and a male bulkhead connector with connection plugs extracted. In some implementations, both bulkheads 104 and 106 use the same connector plug 402. In some implementations, the connector plug 402 is permanently installed into the recess. For example, it can be glued, epoxy sealed, or machine directly into the bulkhead. In some implementations, the connector plug 402 is interchangeable, and attached with removable components such as screws, pins, or latches. In some implementations, the connector plug 402 can allow multiple different pin or connector combinations. The illustrated example connector plug 402 includes eight connection points. Each connection point can be individually interchangeable and can, in some implementations, be a commercial connector insert such as a Blue Trail Engineering Cobalt Connector Insert. In some implementations, the connector plug can be mounted to the bulkhead(s) using a spring-loaded mechanism. That is, when mated, the connector plugs will compress springs, and as the bulkheads are decoupled, the springs will extend. This can be advantageous for sealing the bulkheads and enabling the making of electrical connections in wet or damp environments.

Figure 5:
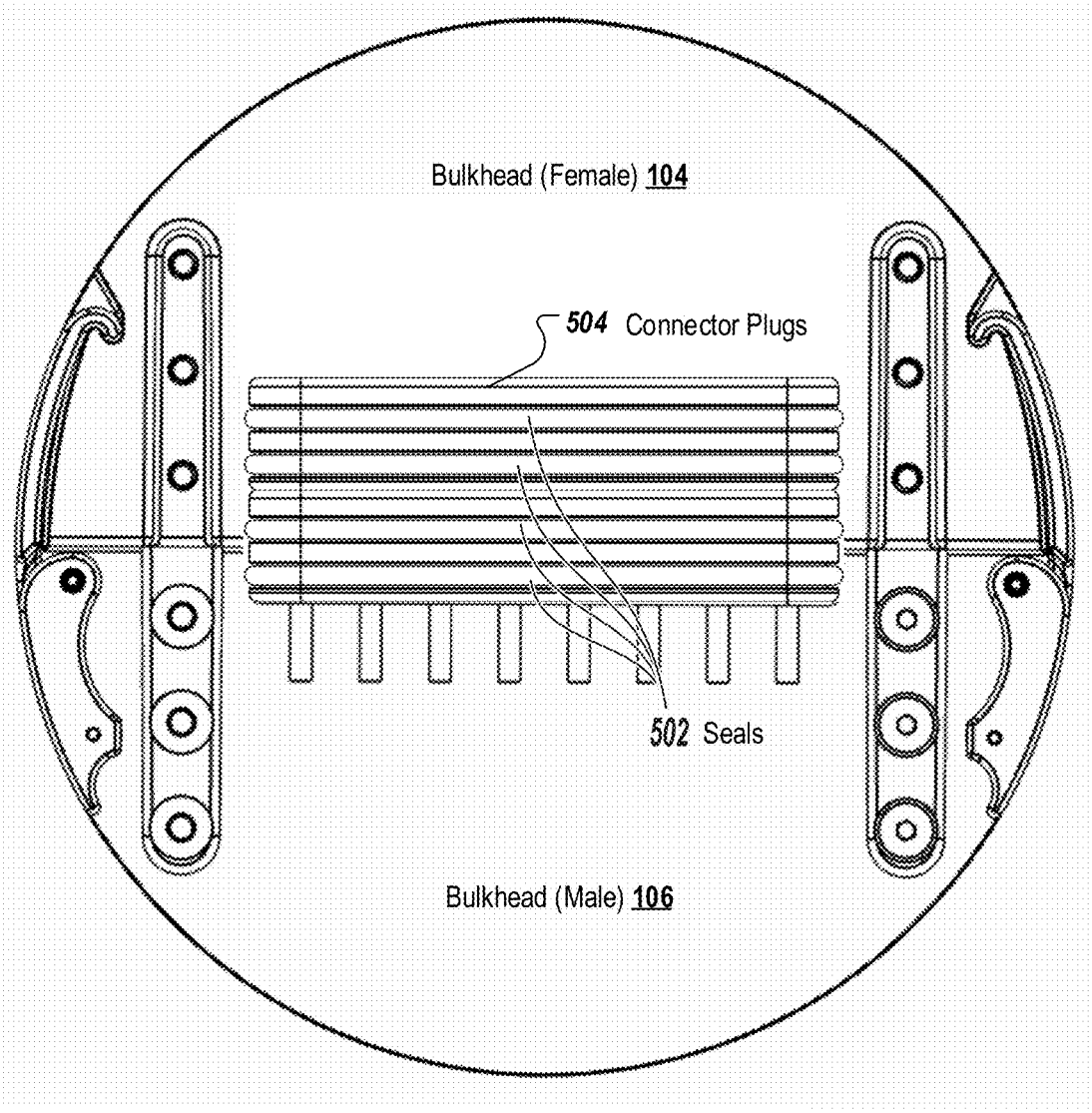
FIG. 5 illustrates a front view of a set of mated bulkhead connectors with connected connector plugs overlaid.

FIG. 5 illustrates a front view of a set of mated bulkhead connectors with connected connector plugs overlayed. When the male bulkhead 106 and female bulkhead 104 are mated, the protruding connector plug on the male bulkhead 106 will connect to the connector plug in the female bulkhead 104 forming a set of mated connector plugs 504.

In the example illustration, the connector plugs 504 include a total of four seals 502. Each seal can be an O-ring, packing and gland seal, or other seal. As illustrated, three of the seals 502 will seat within the recess of the female bulkhead 104, and one will seat within the recess of the male bulkhead 106. It should be noted that FIG. 5 is an example illustration, and more or fewer seals are possible. Additionally, in some implementations, a single connector plug 504, instead of a pair of connector plugs can be used. Further, while illustrated as having eight connection points, more (e.g., 10, 20, etc.) or fewer (e.g., one, two, three, or four, etc.) can be included. Each connection point need not be an electrical connection point. For example, one or more of the connection points can include a tube or vent, to enable gas or liquid exchange between the AUV modules. In some implementation, multiple connector plugs 504 per bulkhead are used. For example, each bulk could have one connector plug for power transmission, and a separate plug (and, in some implementations, a separate recess) for communication signals. Additionally, in some implementations, the connector plugs 504 can be permanently installed or integral with the bulkheads and can include wet-mating connections that include a pin which is inserted into a small grease filled hole evacuating all the grease and pushing out the water while also wiping the pin clean.

Figure 6:
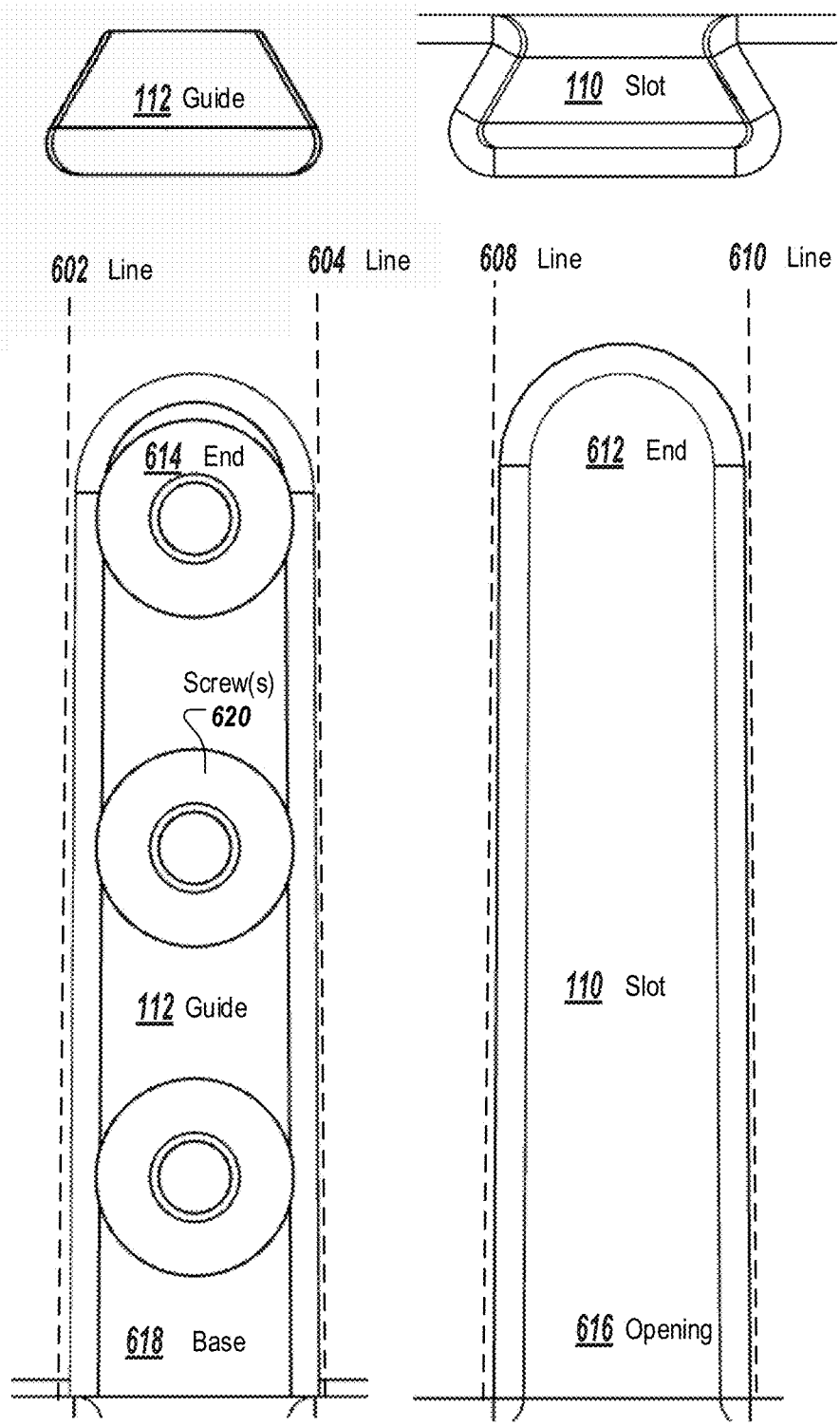
FIG. 6 illustrates a close-up image of an example slot and guide rail for a bulkhead connector in a top view and an end view.

FIG. 6 illustrates a close-up image of an example slot and guide rail for a bulkhead connector in a top view and an end view. The guide 112 can be formed from an aluminum, steel, polymer, or other material, and can be affixed to the bulkhead (e.g., bulkhead 104 of FIG. 1, or bulkhead 106 of FIG. 2). In the illustrated example, it is affixed to the bulkhead using one or more screws 620. In some implementations, the guide 112 can be mounted using adhesive, welded, or directly machined from the bulkhead itself.

The edges of the guide 112, as indicated by lines 602 and 604 taper inwards such that the end 614 is narrower than the base 618 of the guide. Similarly, the slot 110 has edges indicated by lines 608 and 610 which taper inward. The slot 110 is narrower at the end 612 than at the opening 616. By having a slight taper, the guide 112's narrower end 614 can readily fit within the slot's 110 wider opening without perfect alignment. As the guide 112 travels down the slot 110, the tolerance tightens, and the guide 112 and slot 110, and thus the two bulkheads to which they are attached, will self-align. In some implementations, in a fully seated position, each AUV module can be fully self-supported by the other module. That is, the bulkheads are restricted from motion in five degrees of freedom, and do not need to be supported while the latches are engaged. Additionally, during decoupling, there will be minimal contact between slot 110 and guide 112 after an initial unseating. This makes decoupling require less force.

In some implementations, and as illustrated, the ends 614 and 612 of the guide 112 and slot 110 respectively can be rounded or have a circular or semi-circular profile. This can further case initial engagement from misaligned or out of position engagement. The rounded ends 614 and 612 can also reduce the risk of debris collection and be easier to clean and maintain.

While the guide 112 is illustrated with a smooth dovetail shape, in other implementations, the guide 112 can be formed with profiles having other shapes. For example, guide 112 and slot 110 can have a T-shaped or L-shaped profile, among other things. In general, when mated, the guide 112 and slot 110 restrain movement between the two bulkheads in five degrees of freedom. That is, rotation is prevented in any direction (three degrees) and translation is only permitted in a single direction (along the guide/slot) while restricted in the other two (side to side and forward/back). The last degree of freedom can be restricted using the latch 208 as discussed in more detail below with reference to FIG. 7.

Figure 7B:
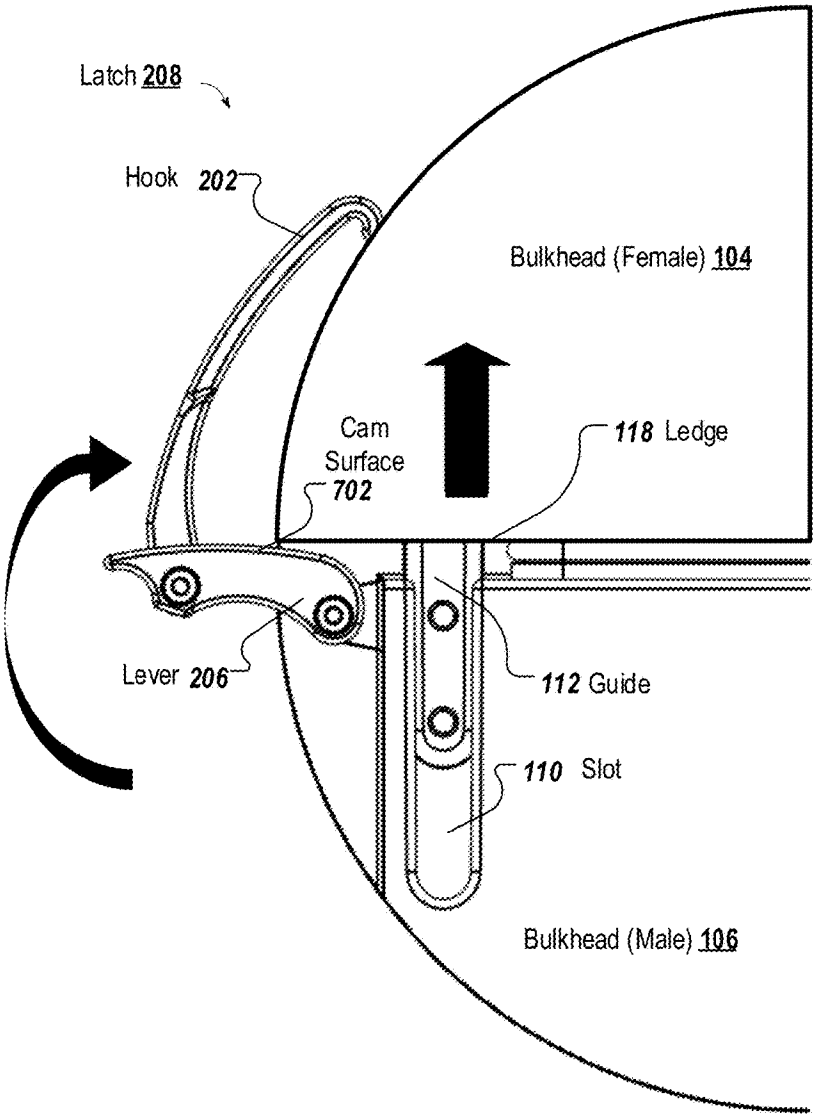
FIGS. 7A and 7B illustrate decoupling a bulkhead connector using a cam surface on a latch lever.
Figure 7A:
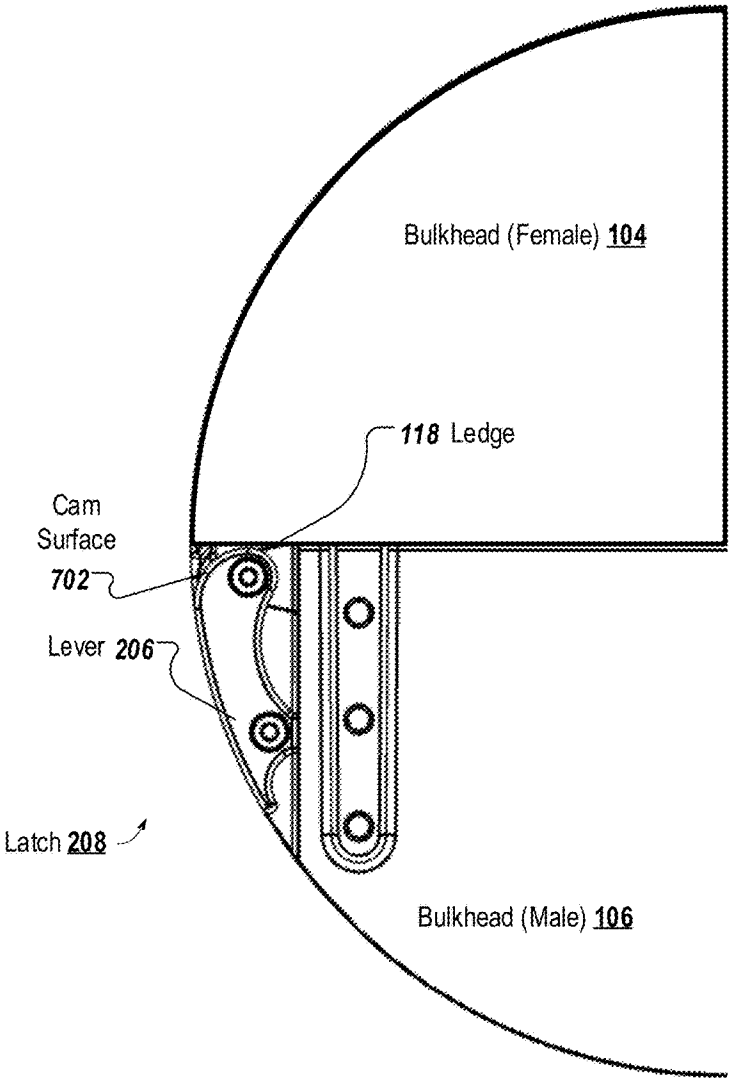

FIGS. 7A and 7B illustrate decoupling a bulkhead connector using a cam surface on a latch lever. During coupling, the female bulkhead 104 is lowered onto the male bulkhead 106 and gravity can assist in providing the necessary force to engage the connector plugs and fully seat the guides 112 into the slots 110. The final coupling force can be generated by the latch 208. When the lever 206 is pressed downward in FIG. 7A or 7B, the hooks generate a downward force to fully seat the female bulkhead 104 onto the male bulkhead 106. Decoupling the bulkheads can present a challenge, particularly where they have been submerged and may have become fouled with debris/corrosion or deformed due to pressure or general wear and tear. To resolve this, the illustrated lever 206 includes a cam surface 702. A portion of the lever is off center from the lever's 206 point of rotation and engages and presses upward on the ledge 118 of the female bulkhead 104 when the lever is lifted. In this manner, the levers 206 can be used to pry the female bulkhead 104 up and off the male bulkhead 106, breaking the electrical connection by disconnecting the enclosed connector plugs, and unseating the guide 112 from within slot 110. It should be noted that the illustrated proportions and shape of lever 206 are an example only. The lever 206 can be longer, which provides additional mechanical advantage, or shorter, which is more compact. Similarly, the pivot point or pin about which the lever 206 rotates could be positioned differently to adjust the latching force and the decoupling force. Additionally, the cam surface 702 can be longer or shorter, or further from the point of rotation, as necessary.

The latch 208, can act as an over-center latch, which ensures that once the hook 202 is engaged, and the lever 206 is lowered beyond a certain amount, additional tension in the hook (or separation forces between the male bulkhead 106 and the female bulkhead 104) can cause the lever to be more tightly seated in the down position. That is, the geometry between the hook 202 and lever 206 is such that the latch 208 forms a bistable with two stable configurations (unlatched or latched). The latch 208 can be designed such that a single latch will prevent the bulkheads from decoupling. That is, while two latches can be provided, they form a redundant system, removing the risk of inadvertent decoupling or disengagement in the event of a single latch failure.

Generally, the cam surface 702 is shaped such that it does not interfere with seating operations of the latch 208 when the lever 206, is in its over-center position or being shut. Then the cam surface 702 engages the ledge 118 when the latch is opened past the over-center position. Additionally, the geometry can be selected to ensure that even with one side's latch closed, the other side's latch can still sufficiently rotate to allow the hook 202 to grab (or release from) the catch 204 before the cam tries to pry the surfaces apart. This allows asynchronous, or single sided latching and unlatching, avoiding the need to manipulate multiple latches at the same time.

Figure 8:
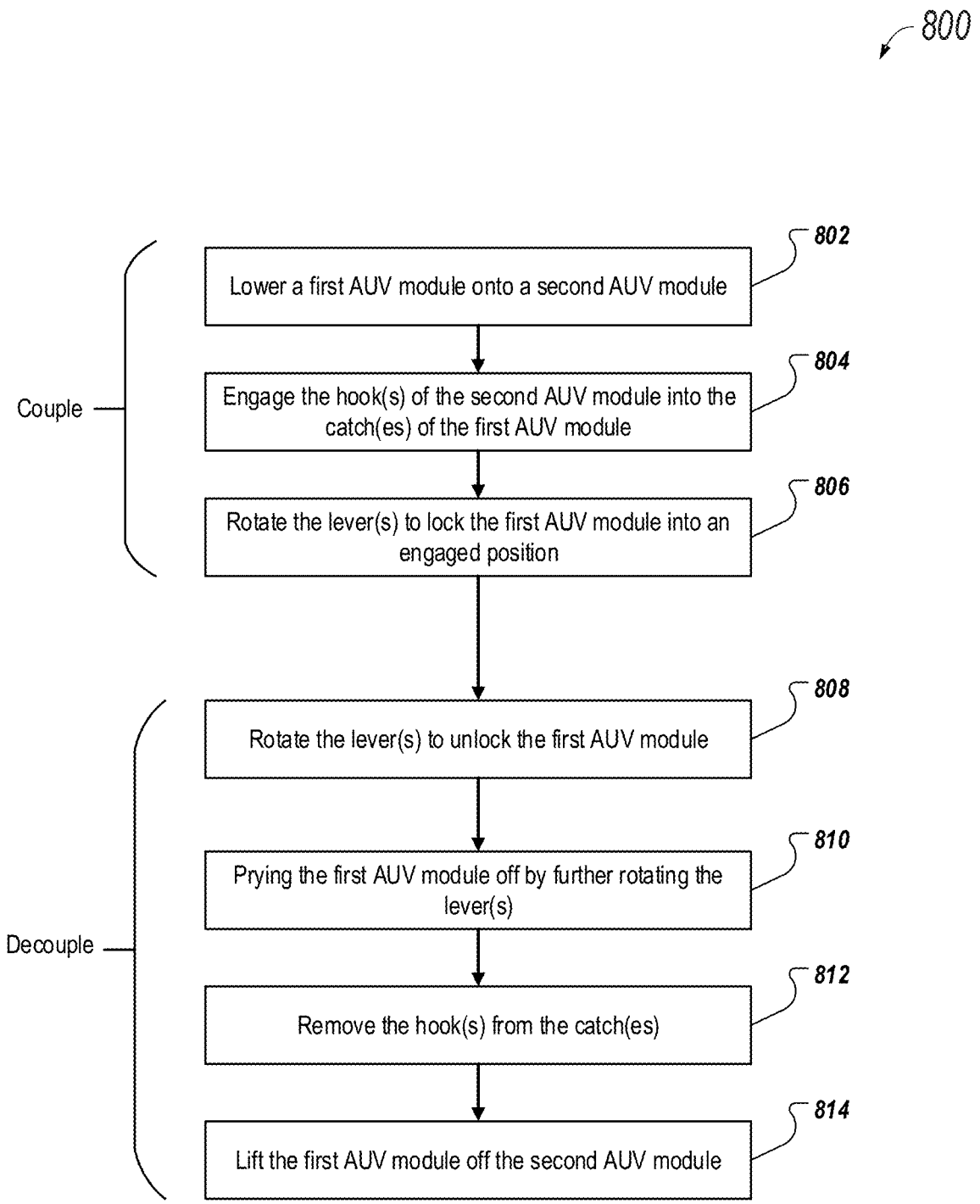
FIG. 8 is a flowchart of an example process for coupling AUV modules.

FIG. 8 is a flowchart of an example process 800 for coupling AUV modules.

At 802, the first AUV module is lowered onto a second AUV module. During the lowering, the guides and slots can engage, allowing the first AUV module to index into the second AUV module. In some implementations, the first AUV module can be lowered by hand. In some implementations, a crane, or other machinery (e.g., lift, dolly, etc.) is used. In some implementations, instead of lowering the first AUV module, it is raised into the second AUV module, or slotted in from the side. Further, while described below as a male and female module, with one having catches and one having latches, as discussed with respect to FIG. 9, other implementations are possible. For example, the first AUV module can include latches, and the second AUV module can include catches.

At 804, hooks of the second AUV module are engaged with catches in the first AUV module. This ensures positive latching when the levers are rotated to couple the modules.

At 806, the levers can be rotated (e.g., down) to place the hooks under tension and restrain movement along the vertical direction for the first AUV module relative to the second AUV module.

At 808, when the first AUV module is to be disengaged, the levers are rotated to unlock the first AUV module. Unlocking can refer to removing tension from the hooks, permitting vertical movement of the first AUV module relative to the second AUV module.

At 810, the first AUV module is pried off the second AUV module by further rotating the levers. In some implementations, this occurs due to cam surfaces on the levers engaging and pressing against a ledge on a bulkhead of the first AUV module. The prying action can unseat the bulkheads from each other and decoupled the electrical connection therein.

At 812, the hooks are removed from their respective catches. In some implementations, 812 is performed prior to 810. In some implementations, 812 automatically occurs as the lever lifts up the hook during rotation.

At 814, the first AUV module is lifted off the second AUV module. In some implementations, the first AUV module is lowered, or slid off to the side of the second AUV module.

The elements of process 800, while shown in a particular sequence, need not necessarily occur sequentially. In some implementations, elements can occur in parallel, or multiple times. Further some elements may not occur at all.

Figure 9:
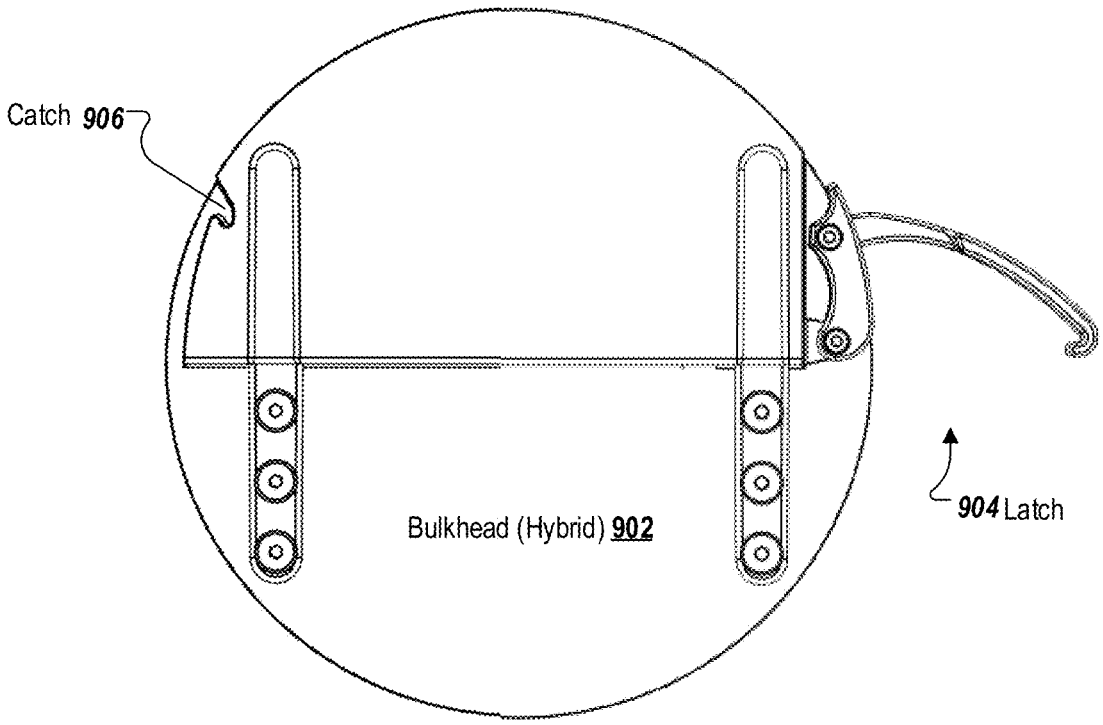
FIG. 9 illustrates an alternative example bulkhead connector.

FIG. 9 illustrates another example bulkhead connector. The illustrated implementation includes both a catch 906 and a latch 904 in the same hybrid bulkhead 902. This hybrid bulkhead 902 is advantageous over the male and female bulkheads 104 and 106 in that it can mate with an identical bulkhead. This can simplify production and reduce costs. However, the male and female bulkheads 104 and 106 as described above are advantageous in that the latches are operated in the same direction (e.g., down, or up) simultaneously when coupling or decoupling the AUV modules. The hybrid bulkhead 902 will require operation of one latch in the upward direction and the other in the downward direction during coupling/decoupling.

The bulkheads 902, 104, and 106 are example implementations, and other implementations are possible and within the scope of this disclosure. For example, a latch-less bulkhead that relies on friction could be used. In other implementations, a single latch, that is on a single side can be used. In some implementations, a latch with an extended flexible hook that wraps further around (e.g., 180 degrees or more) the bulkhead could be used.

This detailed description is merely intended to teach a person of skill in the art further details for practicing certain aspects of the present teachings and is not intended to limit the scope of the claims. Therefore, combinations of features disclosed above in the detailed description may not be necessary to practice the teachings in the broadest sense and are instead taught merely to describe particularly representative examples of the present teachings.

Although an embodiment has been described with reference to specific example embodiments, it will be evident that various modifications and changes may be made to these embodiments without departing from the broader spirit and scope of the present disclosure. Accordingly, the specification and drawings are to be regarded in an illustrative rather than a restrictive sense. The accompanying drawings that form a part hereof show, by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This detailed description, therefore, is not to be taken in a limiting sense, and the scope of various embodiments is defined only by the appended claims, along with the full range of equivalents to which such claims are entitled.

The abstract of the disclosure is provided to allow the reader to quickly ascertain the nature of the technical disclosure. It is submitted with the understanding that it will not be used to interpret or limit the scope or meaning of the claims. In addition, in the foregoing detailed description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the detailed description, with each claim standing on its own as a separate embodiment.

The invention claimed is:

1. A method comprising:

lowering a first autonomous underwater vehicle (AUV) module comprising a first bulkhead onto a second AUV module comprising a second bulkhead, wherein the first bulkhead comprises a first slot that receives a second guide rail of the second bulkhead, and wherein the second bulkhead comprises a second slot that receives a first rail of the first bulkhead;

engaging at least one hook of a latch of the second bulkhead with at least one catch of the first bulkhead; and rotating at least one lever of the latch of the second bulkhead into an engaged position to couple the first bulkhead with the second bulkhead.

2. The method of claim 1, wherein when the first bulkhead and the second bulkhead are coupled, a first connector plug and a second connector plug form an electrical connection.

3. The method of claim 1, wherein the first bulkhead is coupled to a first hull of the first AUV module to form a pressure tight first AUV module, and wherein the second bulkhead is coupled to a second hull of the first AUV module to form a pressure tight second AUV module.

4. The method of claim 1 comprising:

submerging the coupled first AUV module and second AUV module in a liquid.

5. The method of claim 1, comprising:

decoupling the first AUV module and the second AUV module by rotating the at least one lever of the latch into a disengaged position;

removing the hook from the catch; and lifting the first AUV module off the second AUV module.

* * * * *